US007766802B2

(12) United States Patent
Webber et al.

(10) Patent No.: US 7,766,802 B2
(45) Date of Patent: Aug. 3, 2010

(54) ROWING EXERCISE MACHINE WITH SELF-ALIGNING PIVOTING USER SUPPORT

(75) Inventors: Randall T. Webber, La Jolla, CA (US); Bruce Hockridge, San Diego, CA (US); Jeffrey O. Meredith, Del Mar, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 97 days.

(21) Appl. No.: 12/105,833

(22) Filed: Apr. 18, 2008

(65) Prior Publication Data

US 2008/0214365 A1 Sep. 4, 2008

Related U.S. Application Data

(63) Continuation-in-part of application No. 10/633,805, filed on Aug. 4, 2003, now Pat. No. 7,594,880.

(51) Int. Cl.
*A63B 21/00* (2006.01)

(52) U.S. Cl. ..... 482/100; 482/136; 482/72

(58) Field of Classification Search ..... 482/100, 482/136, 137, 139, 72, 73, 94–97, 130
See application file for complete search history.

(56) References Cited

U.S. PATENT DOCUMENTS 2,145,940 A 2/1939 Marlowe
4,441,708 A 4/1984 Brentham
4,641,833 A 2/1987 Trethewey
4,743,010 A 5/1988 Geraci
4,822,038 A 4/1989 Maag
4,843,051 A * 6/1989 Kovacs et al. ..... 502/42
4,844,456 A 7/1989 Habing et al.
4,943,051 A * 7/1990 Haskins et al. ..... 482/72
4,944,641 A 7/1990 Habing
4,949,958 A 8/1990 Richey (Continued)

FOREIGN PATENT DOCUMENTS

CA 2075331 2/1994

OTHER PUBLICATIONS

U.S. Appl. No. 12/212,090 of Webber et al. filed Sep. 17, 2008.

(Continued)

*Primary Examiner*—Jerome Donnelly
(74) *Attorney, Agent, or Firm*—Procopio, Cory, Hargreaves & Savitch LLP

(57) ABSTRACT

A rowing or mid-row exercise machine has a main frame and a user support frame pivotally mounted relative to the main frame for rotation between start and end positions. The user support frame supports spaced positions on a user's body in the same relative orientation throughout an exercise movement. A user engagement device is movably mounted relative to the frames and has at least one handle gripped by the user in performing exercises. The handle is movable in a predetermined rowing exercise path between a start position spaced in front of a user's chest and an end position closer to the chest. A connecting linkage translates movement of the user engagement device to rotational movement of the user support frame. A load resists movement of at least one of the user support, user engagement device, and connecting linkage.

56 Claims, 11 Drawing Sheets

U.S. PATENT DOCUMENTS 5,236,406 A 8/1993 Webber
5,254,067 A 10/1993 Habing et al.
5,330,404 A 7/1994 Lopeteguy et al.
5,330,405 A 7/1994 Habing et al.
5,342,270 A 8/1994 Jones
5,352,171 A 10/1994 Lin
5,354,248 A 10/1994 Rawls et al.
5,356,357 A * 10/1994 Wang et al. ..... 482/96
5,356,358 A 10/1994 Chen
5,401,227 A 3/1995 Webber
D357,041 S 4/1995 McBride et al.
5,417,634 A 5/1995 Habing
5,478,298 A 12/1995 Chen
5,520,599 A 5/1996 Chen
5,527,243 A 6/1996 Chen
5,527,250 A 6/1996 Chen
5,533,953 A 7/1996 Lui et al.
D372,509 S 8/1996 Yang
5,547,444 A 8/1996 Huang et al.
5,573,482 A 11/1996 Wang et al.
5,580,340 A * 12/1996 Yu ..... 482/96
5,582,563 A 12/1996 Fan
5,616,105 A 4/1997 Wang
5,626,542 A 5/1997 Dalebout et al.
5,643,147 A * 7/1997 Huang ..... 482/72
5,669,865 A 9/1997 Gordon
5,674,161 A 10/1997 Lin
5,681,247 A 10/1997 Webber
5,683,334 A 11/1997 Webber
5,720,695 A 2/1998 Eckmann
5,722,918 A * 3/1998 Lee ..... 482/72
5,800,321 A 9/1998 Webber
5,810,698 A 9/1998 Hullett et al.
5,899,836 A 5/1999 Chen
5,916,072 A 6/1999 Webber
5,938,570 A 8/1999 Maresh
5,944,641 A 8/1999 Habing
5,961,427 A 10/1999 Habing et al.
5,961,428 A 10/1999 Webber
6,004,247 A * 12/1999 Webber ..... 482/100
6,030,322 A 2/2000 Webber
6,090,020 A 7/2000 Webber
6,135,930 A 10/2000 Kuo
6,142,914 A 11/2000 Crawford et al.
6,162,153 A 12/2000 Perez et al.
6,264,588 B1 7/2001 Ellis
6,312,366 B1 11/2001 Prusick
6,319,178 B1 11/2001 Webber
6,561,960 B2 5/2003 Webber
6,579,213 B1 6/2003 Webber et al.
6,605,024 B2 8/2003 Stearns
6,752,748 B1 * 6/2004 Scotti ..... 482/140
6,811,522 B1 11/2004 McQuinn
6,855,098 B2 2/2005 Reitz et al.
6,916,278 B2 7/2005 Webber
6,971,978 B2 12/2005 Hyder
6,988,977 B2 1/2006 Webber et al.
7,052,444 B2 5/2006 Webber
7,052,446 B2 5/2006 Morris et al.
7,070,545 B2 7/2006 Lull et al.
7,108,641 B2 * 9/2006 Pertegaz-Esteban ..... 482/139
7,141,003 B2 11/2006 Wu
7,141,008 B2 11/2006 Krull et al.
7,166,066 B2 1/2007 Webber
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,361,125 B2 4/2008 Webber et al.
7,384,381 B2 6/2008 Webber et al.
7,468,024 B2 12/2008 Webber et al.
2002/0013199 A1 1/2002 Giannelli et al.
2002/0187879 A1 12/2002 Ball et al.
2003/0199362 A1 10/2003 Chamberlin
2005/0032611 A1 2/2005 Webber et al.
2006/0247107 A1 11/2006 Carter
2006/0276313 A1 12/2006 Hong
2007/0232462 A1 10/2007 Webber et al.
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214367 A1 9/2008 Webber et al.
2008/0220950 A1 9/2008 Webber et al.
2008/0234110 A1 9/2008 Webber et al.
2008/0242517 A1 10/2008 Webber et al.
2008/0248929 A1 10/2008 Webber et al.

OTHER PUBLICATIONS

Hoist Prime 8 Brochure, Hoist Fitness Systems, 2000.

* cited by examiner

ROWING EXERCISE MACHINE WITH SELF-ALIGNING PIVOTING USER SUPPORT

RELATED APPLICATION

The present application is a Continuation-In-Part of co-pending U.S. patent application Ser. No. 10/633,805 filed on Aug. 4, 2003, the contents of which are incorporated herein by reference in their entirety.

BACKGROUND

1. Field of the Invention

This invention relates generally to exercise machines, and is particularly concerned with a rowing exercise machine with a pivoting user support.

2. Related Art

There are several different types of exercise for exercising back muscles, including mid-row exercises. These exercises can be difficult for many people to perform using free weights, requiring balance and coordination as well as strength to follow the proper movement path. Free rowing exercises often require an exerciser to bend at the waist, which is undesirable. Improper form by the exerciser can make the exercise more difficult, increase stress on the joints, and even lead to possible injury.

Various exercise machines have been developed for performing rowing and other exercises. Some of these have a stationary user support, while others have a pivoting or movable user support, which may or may not be linked to the exercise arm or user engagement means. One problem in most or all prior art designs is the unnatural and exaggerated arcing movement found in pivoting arm exercise machines, which do not accurately simulate the natural body movement found in free weight and/or free bar exercises.

Movable user supports linked to the movement of an exercise arm are extremely common in exercise machines for performing many different exercises, and are generally known as composite motion exercise machines. U.S. Pat. No. 2,252,156 of Bell and U.S. Pat. No. 6,251,047 of Stearns show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in multi-purpose exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another multi-purpose exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight opposes the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition, so that the seat and backrest move relative to one another and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance.

Current exercise machines with pivoting or movable user supports often do not accurately maintain proper positioning of the user throughout the exercise motion, can result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, potentially causing strain or injury.

SUMMARY

Embodiments described herein provide for a rowing exercise machine with a pivoting user support.

A rowing or mid-row exercise machine in one embodiment comprises a floor engaging main frame, a user support frame pivotally associated with the main frame, a user engagement device movably mounted on one of the frames for actuating by a user in order to perform a rowing exercise, and a connecting linkage which links movement of the user engagement device to movement of the user support. A load provides resistance to movement of the user support frame, user engagement device and/or connecting linkage. The connecting linkage, user support pivot, and user engagement device mount are arranged so that movement of the user engagement device results in self-aligning movement of the user support. In one embodiment, the user engagement device has at least one exercise arm which is at least partially rigid and has a handle gripped by a user when performing a rowing exercise, the handle moving in a predetermined exercise path from a start position spaced in front of the user's chest to an end position drawn in closer to the user.

The user support frame in an exemplary embodiment has both a primary user support, such as a seat pad or back pad, and a secondary user support, such as a back pad, shoulder pad, thigh hold-down pads, chest pad, or the like. It may also have a supplementary stabilization means such as a foot rest, which may be mounted on, and travel with, the user support frame. Alternatively, a foot rest may be mounted on the main frame. In either case, the foot rest provides additional stabilization to the user, helping them to maintain a proper exercise position and providing additional comfort and support. The use of multiple support pads on the user support frame helps to position the exerciser properly and safely. These supports are in fixed alignment to each other and travel together, keeping the user in the same braced position throughout the entire exercise range of motion. This allows the user to focus on the exercise rather than worrying about their positioning on a moving platform or seat.

The exercise arm or user engagement device is movably mounted on the main frame, the user support frame, or the connecting linkage. The connecting linkage translates movement of the exercise arm to movement of the user support, and is movably engaged with at least two of the main frame, exercise arm, and user support. In one embodiment, the user engagement device is movably mounted on the main frame and associated with the connecting linkage. The user support and exercise arm may both be movably mounted on the main frame, with the connecting linkage connected between them. The exercise arm may be mounted for linear movement or may be pivotally mounted for rotational movement.

The user support frame may be pivotally mounted on the base of the main frame so that it is relatively low to the ground and readily accessible to the user in entering and exiting the machine, via a single pivot or a multiple pivot assembly. In one embodiment, the user engagement device is also movably mounted on the base of the main frame. In other embodiments, the user engagement device is movably mounted relative to an upright portion of the main frame. The user engagement device may comprise completely rigid or partially rigid exercise arms with handles for gripping by the user which are movable between a start position spaced forwardly from the user's chest and an end position which is drawn in just in front of the user's chest. The user's hands may be at a slightly lower elevation relative to the shoulders in the end position than in the start position. The movement mimics the slight, naturally arcing movement of the upper body when rowing without any bending at the waist, which is undesirable and can occur with a free rowing exercise.

A pivot assembly which pivotally supports the user support frame may be located beneath the frame. The connecting linkage may be rigid, flexible, or partially flexible, and may be adjustable in length or position. The user engagement device or exercise arm may have one or two handles. If handles are provided, they may be rigid or flexible, fixed or self-aligning, and may provide two dimensional or three dimensional hand movement.

The handles and associated exercise arms may be movable independently or in unison. In one embodiment, the user engagement device and connecting linkage are both movably associated with the main frame. The user engagement device may be a bi-directional exercise arm.

In some embodiments, the end position of the user support frame is inclined rearward relative to the start position, while in others the end position is inclined forward relative to the start position. In one embodiment, the primary support is a seat pad which may be horizontal or inclined in the start position. The seat pad is rearwardly inclined in an exercise start position in one embodiment, and is moved through a horizontal orientation to a different inclined position in the exercise end position. In another embodiment, the seat pad is forwardly inclined in the start position and rearwardly reclined in the end position. In another embodiment, the seat pad does not travel through a horizontal orientation but is rearwardly reclined in the start position and ends in a position which is rotated forward relative to the start position but still rearwardly reclined. The secondary support may comprise an upright support pad for the user's back or chest. Because the user support moves in conjunction with the exercise arm or user engagement device, the arcuate path of the exercise arm relative to the user support is reduced. The result is a more natural feeling exercise movement that more closely replicates the movement found in the corresponding free weight exercise.

The pivot mounting of the user support defines a vertical gravitational center line of the pivotal movement, and in one embodiment portions of the combined weight of the user and user support frame are positioned on both sides of the vertical gravitational center line in at least one of the start and end positions of the exercise. In one embodiment, a portion of the combined weight of the user and user support is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the gravitational center line of the pivoting movement, resulting in either a high initial lifting resistance, or else a resistance "drop off" at the end of the exercise.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a rowing exercise machine having a stationary main frame as well as an exercise arm or user engagement device and user support frame which travel in a dependent relationship. The user engagement device has one or more handles which are gripped by the user and arm portions movably linking the handles to one of the user support, main frame or a connecting linkage which translates movement of the handles into movement of the user support.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 2:
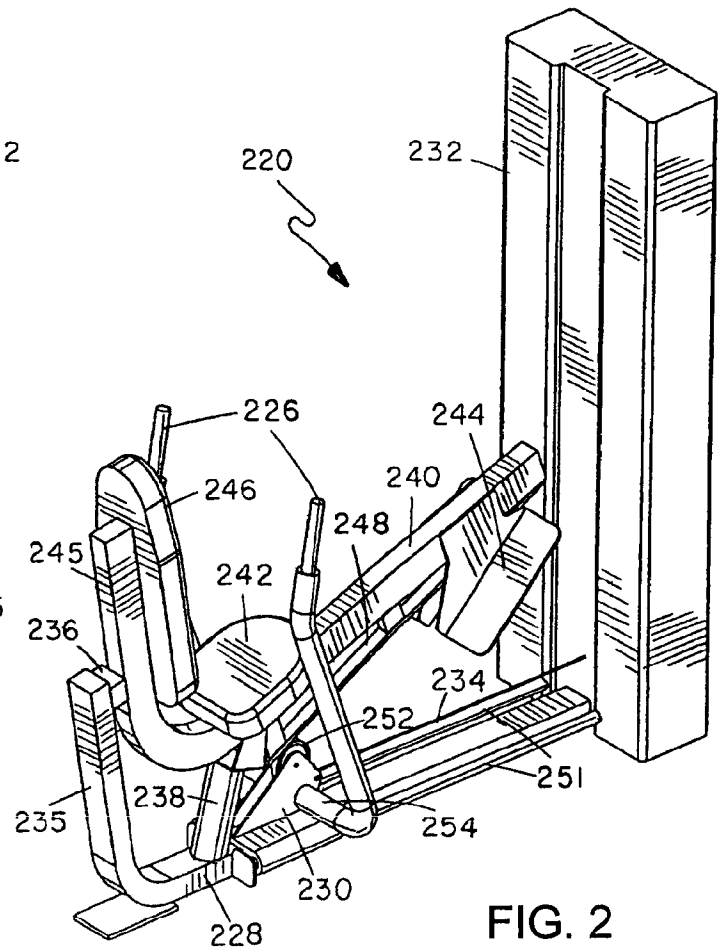
FIG. 2 is a rear perspective view similar to FIG. 1, illustrating the machine in an exercise end position.
Figure 1:
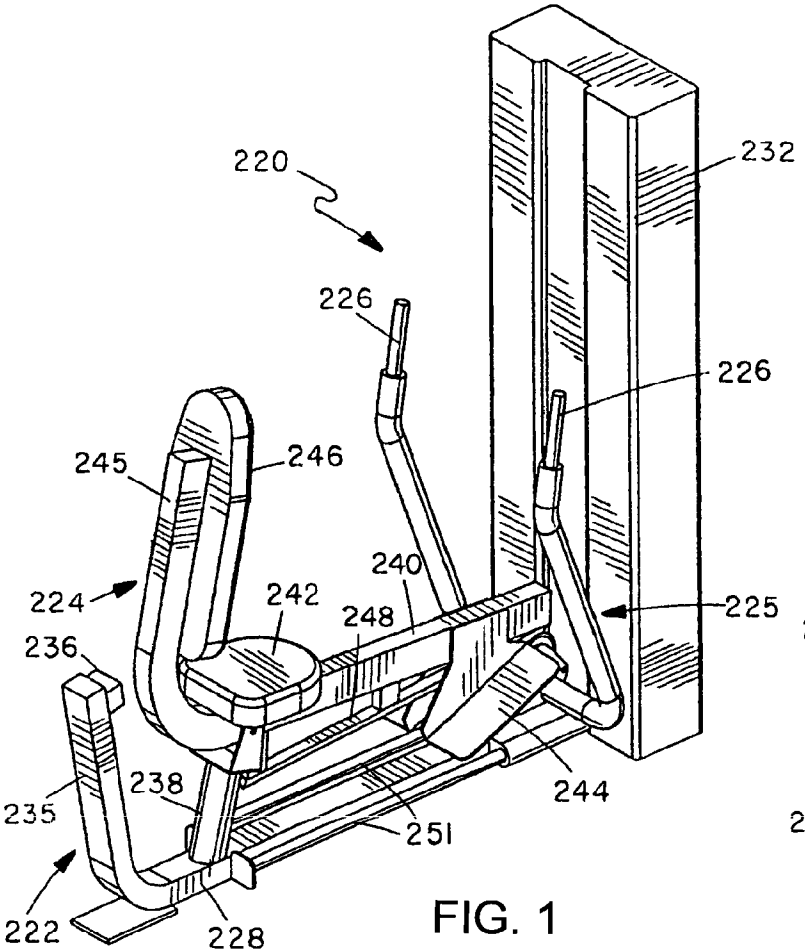
FIG. 1 is a rear perspective view of a rowing or mid-row exercise machine according to one embodiment, with the machine illustrated in a start position adopted at the beginning of an exercise movement.
Figure 3:
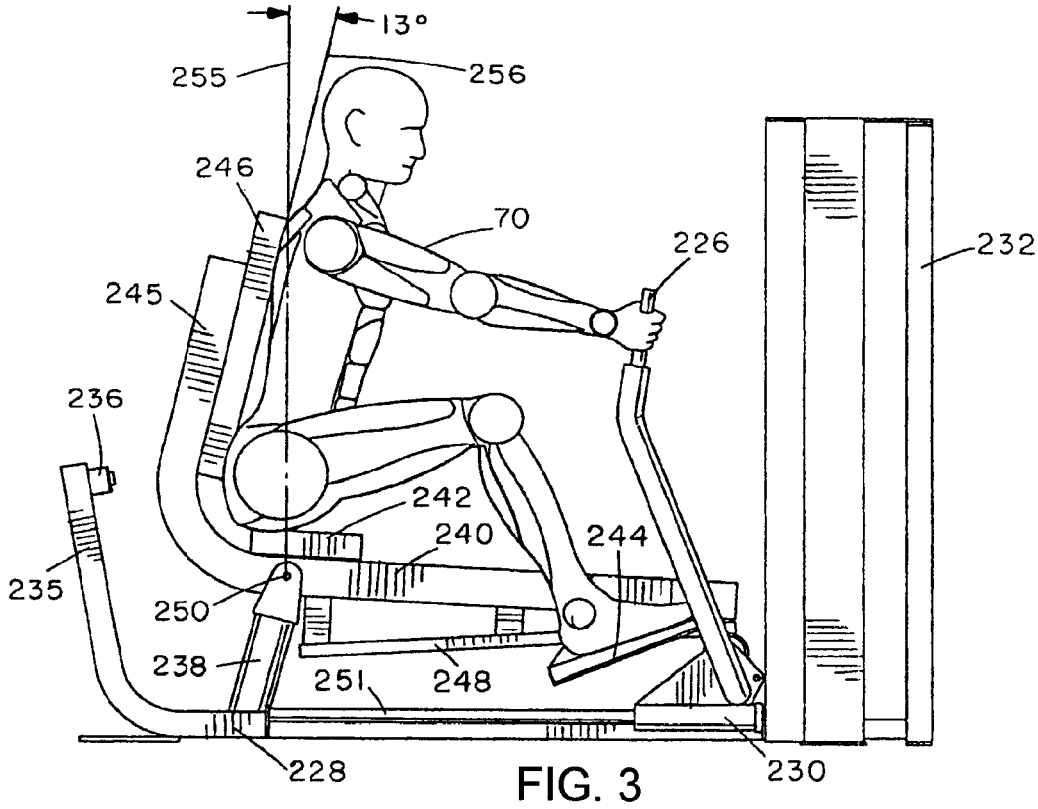
FIG. 3 is a side elevation view of the machine of FIGS. 1 and 2, with a user seated on the machine in the start position adopted at the beginning of the exercise.
Figure 4:
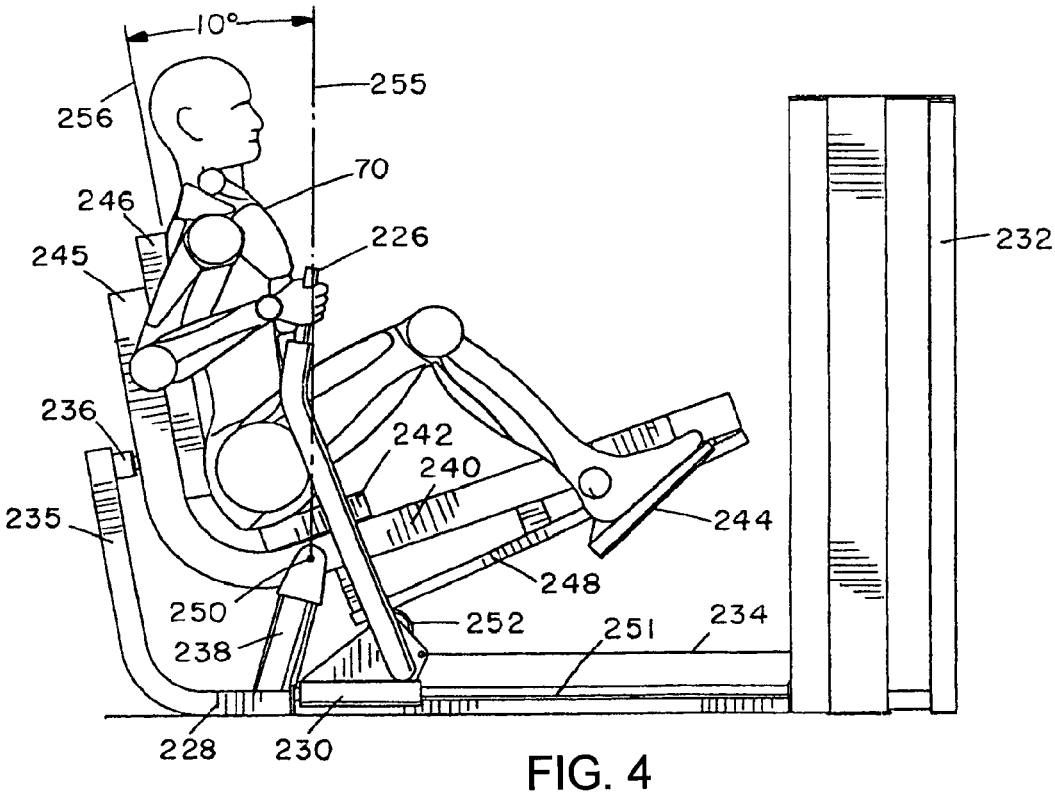
FIG. 4 is a side elevation view similar to FIG. 3, illustrating the user and machine in the end position of the exercise.

FIGS. 1 to 4 illustrate a mid row exercise machine 220 according to one embodiment, for performing a rowing exercise. FIG. 1 illustrates the machine in a start position while FIG. 2 illustrates the finish position, with FIGS. 3 and 4 illustrating the same positions with a user 70 performing the exercise.

The exercise machine 220 comprises a main frame 222 and a user support 224 pivotally mounted on the frame. A U-shaped user engagement device or exercise arm 225 with handles 226 at its free, upper ends is slidably mounted on the base 228 of the frame 222 via linear slide or carriage 230. The linear slide 230 is linked to an exercise resistance, in this case a weight stack in housing 232, via a cable and pulley linkage, most of which is concealed within the weight stack housing, with the cable 234 of the linkage connected to the slide 230 as indicated in FIG. 2. The linear slide or sliding wedge 230 is also linked to the underside of the user support 224, as described in more detail below, and forms part of a connecting linkage which translates movement of the exercise arm into movement of the user support. The sliding wedge linkage between the exercise arm and user support is similar to that described in U.S. Pat. No. 6,916,278, the contents of which are incorporated herein by reference.

The main frame also has a slightly rearward inclined upright strut 235 at the rear end of base 222, which has a stop pad 236 at its upper end forming a rest for the user support in the exercise end position of FIGS. 2 and 4, and a pivot mounting post 238 extending upwardly from the base at a position spaced forward from upright strut 235. The user support 224 is generally L-shaped, and has a base 240 on which a seat pad 242 is mounted, with a pair of foot rests or foot plates 244 secured adjacent the forward end of base 240, and an upright 245 supporting back pad 246. A guide bar or track 248 is mounted on the underside of the base 240 of the user support so as to extend at an upwardly inclined angle from the rear end to the forward end, as best illustrated in FIGS. 3 and 4. The user support is pivoted to the pivot mount 238 via a pivot 250 located beneath the seat pad 242.

The linear slide or wedge 230 has a lower sleeve portion which is slidably engaged on a pair of parallel, linear guide bars 251 on the base 228 of the frame, and an upper wedge shaped portion comprising spaced parallel plates with a wheel 252 rotatably mounted between the plates at its upper end for rolling engagement on the guide bar or track 248 on the underside of the user support base. The central portion 254 of the U-shaped exercise arm is rigidly mounted on the slide or wedge 230. Rearward linear motion of the exercise arm is translated into rearward rotational movement of the user support with this arrangement.

FIGS. 3 and 4 illustrate a user 70 performing a rowing type of exercise, also known as a mid row exercise, on the machine 220. In FIGS. 3 and 4, dotted line 255 is the gravitational centerline of the user support pivot 250, while dotted line 256 represents the orientation of the user support back rest, or the back of the user when seated on the support. To perform the exercise, the user sits on the seat with the user support in the position illustrated in FIG. 3, and places their feet on the foot support plates 244 while gripping handles 226 with their arms straight out in front. The user support is initially positioned in a back supported, forwardly inclined position, so that the user's body is initially at a forward lean of around 13 degrees off vertical. The user's arms extend straight forwards with their hands slightly below shoulder level, which is similar to the starting position for a free rowing exercise.

The user then pulls handles 226 towards their body in a rowing action, simultaneously pulling the slide or wedge 230 along the rails 251. This wedges the wheel 252 along the angled user support guide bar 248, rotating the user support rearward about pivot 250, and moving the user from a slightly forwardly inclined position to a reclined position, ending with their arms pulled back and their hands at a slightly lower elevation, relative to their shoulders, than the starting position, as seen in FIG. 4. This follows a natural rearward arcing rowing motion. The end position of the user in FIG. 4 is similar to the end position for a free rowing. This exercise machine mimics the slight, naturally arcing movement of the upper body when rowing a boat or exercising on a rowing machine, without allowing the user to bend at the waist, which is undesirable and can occur with a free rowing exercise.

In the exercise machine of this embodiment, the user support pivot 250 is positioned directly under the exerciser. The gravitational centerline 255 runs very close to the centerline of the user's hip, allowing a balanced portion of the user and user support to be positioned on each side of the gravitational centerline in both the start and finish position. Because the user support seat 242 rises upward as it rotates and the exercise arm travels in a straight line, the positioning of the exerciser's hands, relative to their shoulders, is slightly higher in the starting position than the finish position. This involves more of the back muscles and combines multiple lat pull movements in one exercise, which is not possible with a conventional rowing machine exercise using a cable.

Figure 5:
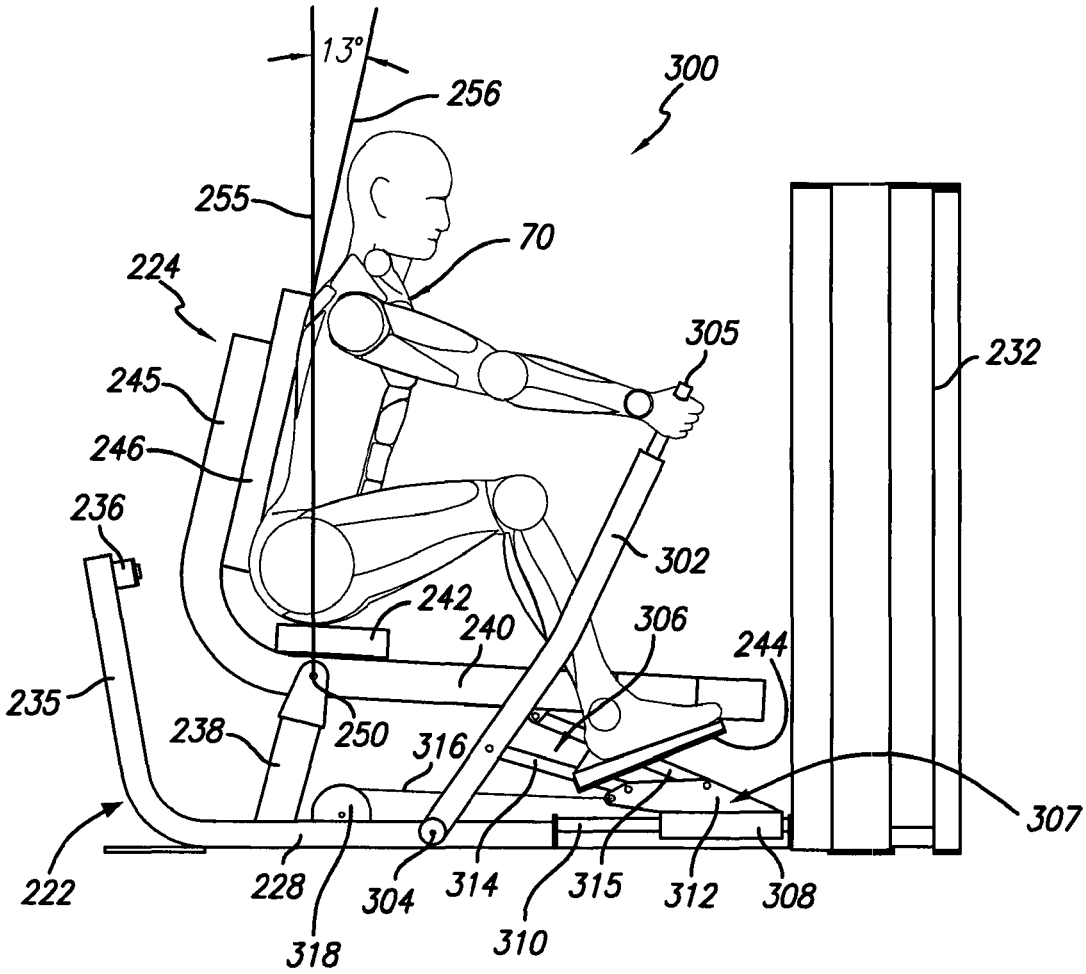
FIG. 5 is a side elevation view of a mid-row exercise machine according to another embodiment, with a user seated on the machine in the start position adopted at the beginning of the exercise.
Figure 6:
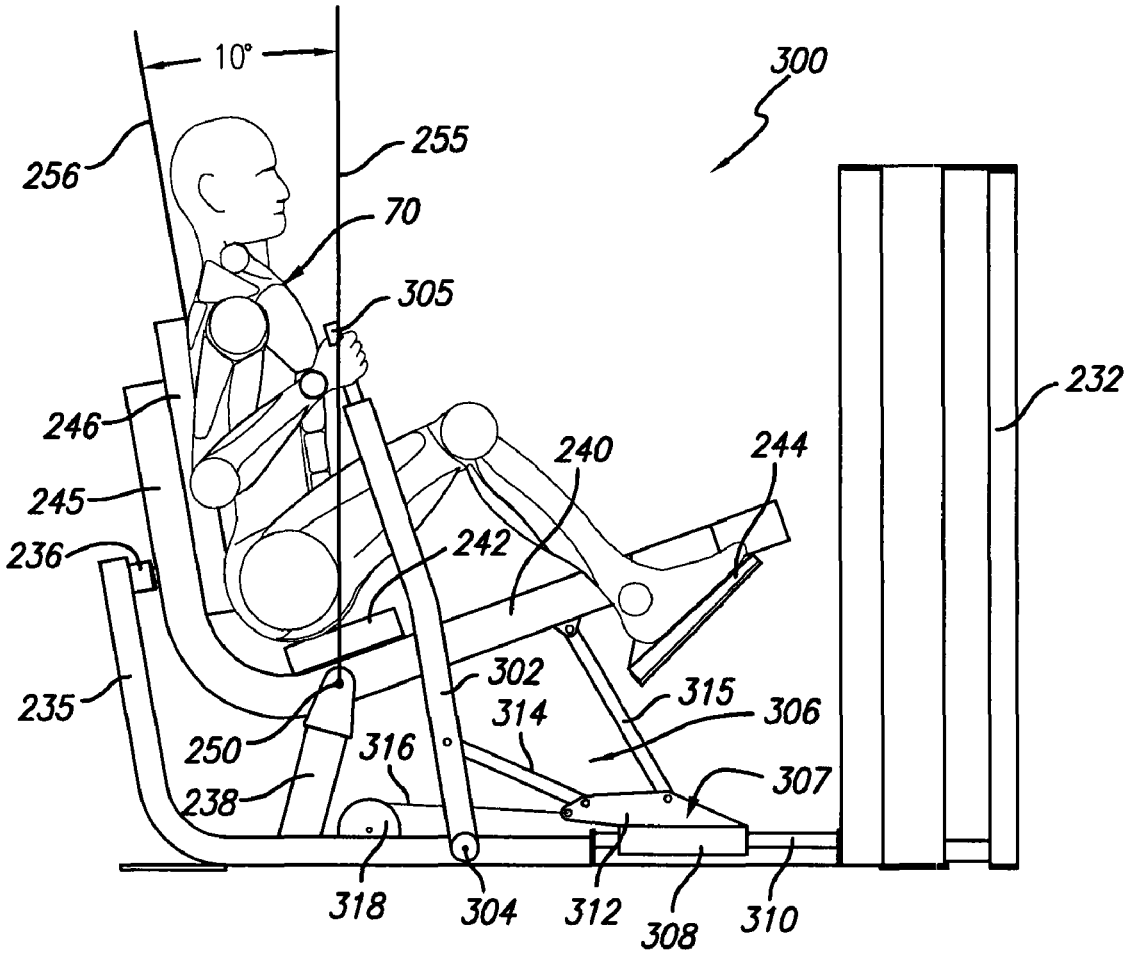
FIG. 6 is a side elevation view of the mid-row exercise machine of FIG. 5 with the user and machine in the end position of the exercise.

FIGS. 5 and 6 illustrate a modified rowing or mid-row exercise machine 300 according to another embodiment, in which the exercise arm and connecting linkage are different from the previous embodiment but the user support moves in a similar manner from a slight forward inclination in the start position to a rearward inclination in the end position. Some parts of the machine in FIGS. 5 and 6 are identical to parts in the previous embodiment, and like reference numbers are used for like parts as appropriate.

As in the previous embodiment, a generally L-shaped user support frame 224 is pivotally mounted on main frame 222 via a pivot at the upper end of pivot mount 238 so as to rotate about pivot axis 250. Unlike the previous embodiment, a user engagement device or exercise arm 302, which may comprise separate arms on each side of the main frame, or a U-shaped exercise arm as in the previous embodiment, is pivoted to the base 228 of the main frame for rotation about pivot axis 304. The user engageable exercise arm 302 has hand grips 305 at its upper ends.

The connecting linkage 306 in this embodiment is a multiple part linkage which includes a sliding link or carriage 307 which is slidably engaged on the base of the main frame, and pivoted links 314, 315 extending between the carriage and the exercise arm, and between the carriage and the user support frame, respectively. The sliding link or carriage 307 has a sleeve 308 slidably engaging a pair of parallel rails or guide bars 310 on the base of the frame, which are similar to the guide rails 251 of the previous embodiment but do not extend as far back as the rails 251 due to the reduced distance of sliding movement required in this embodiment. The carriage 307 further comprises a connecting plate or plates 312 mounted on top of sliding sleeve 308. The first pivoted link 314 is pivoted to plate 312 at one end and to the exercise arm 302 at the opposite end, and a second pivoted link 315 is pivoted to the plate at one end and pivoted to the base 240 of the user support frame at the opposite end. The pivot connections of the two links 314 and 315 to sliding link connecting plate 312 are spaced from one another. The connecting plate 312 is also connected to the load in weight stack 232 via cable 316 which extends from a rear end of connecting plate 312, round a pulley 318 on the base of the frame, and then forward to the weight stack housing where it is linked in a conventional manner to a selected number of the weights in the weight stack housing.

The user 70 starts the exercise in a position similar to the start position of the previous embodiment, as illustrated in FIG. 5, with the seat pad 242 at a slight downward inclination, the back pad 246 inclined forward at an angle of around 13 degrees, and the user's arms extending forward and gripping the handles 305 at the upper ends of exercise arms 302, which also start in a forwardly pivoted orientation but at a greater angle of inclination than the back pad or back rest 246. In this position, the two pivoted links 314, 315 are both pivoted downwards and almost parallel to one another, while the sliding link 308 is at the forward end of the rails 310.

In order to perform a rowing exercise, the user pulls handles 305 towards their body in a rowing action, simultaneously rotating exercise arms 302 rearward about the pivot 304. Rearward rotation of arms 302 pulls pivoted link 314 rearward and upward at its end which is secured to the exercise arm, and simultaneously pulls the sliding carriage rearward along rail 310. Movement of the carriage also moves the lower end of pivoted link 315 rearward, simultaneously rotating the link 315 forward and upward at its upper end which is secured to the base of the user support. This tilts the user support upward at its forward end, moving the user and user support from a slightly forwardly inclined position to a reclined position. The user ends the exercise with their arms pulled back and their hands at a slightly lower elevation relative to their shoulders than the starting position, as seen in FIG. 6. This follows a natural rearward arcing rowing motion. The end position of the user in FIG. 6 is similar or identical to the end position of FIG. 4 of the previous embodiment, with the back rest tilted rearward from the vertical at an angle of around 10 degrees. Again, this exercise machine mimics the slight, naturally arcing movement of the upper body when rowing a boat or exercising on a rowing machine, without allowing the user to bend at the waist, which is undesirable and can occur with a free rowing exercise.

In the exercise machine of this embodiment, as in the previous embodiment, the user support pivot 250 is positioned directly under the exerciser. The gravitational centerline 255 runs very close to the centerline of the user's hip, allowing a balanced portion of the user and user support to be positioned on each side of the gravitational centerline in both the start and finish position. Because the user support seat 242 rises upward as it rotates and the exercise arm rotates about a pivot axis at its lower end, the positioning of the exerciser's hands, relative to their shoulders, is slightly higher in the starting position than the finish position. This involves more of the back muscles and combines multiple lat pull movements in one exercise, which is not possible with a conventional rowing machine exercise using a cable.

Figure 7:
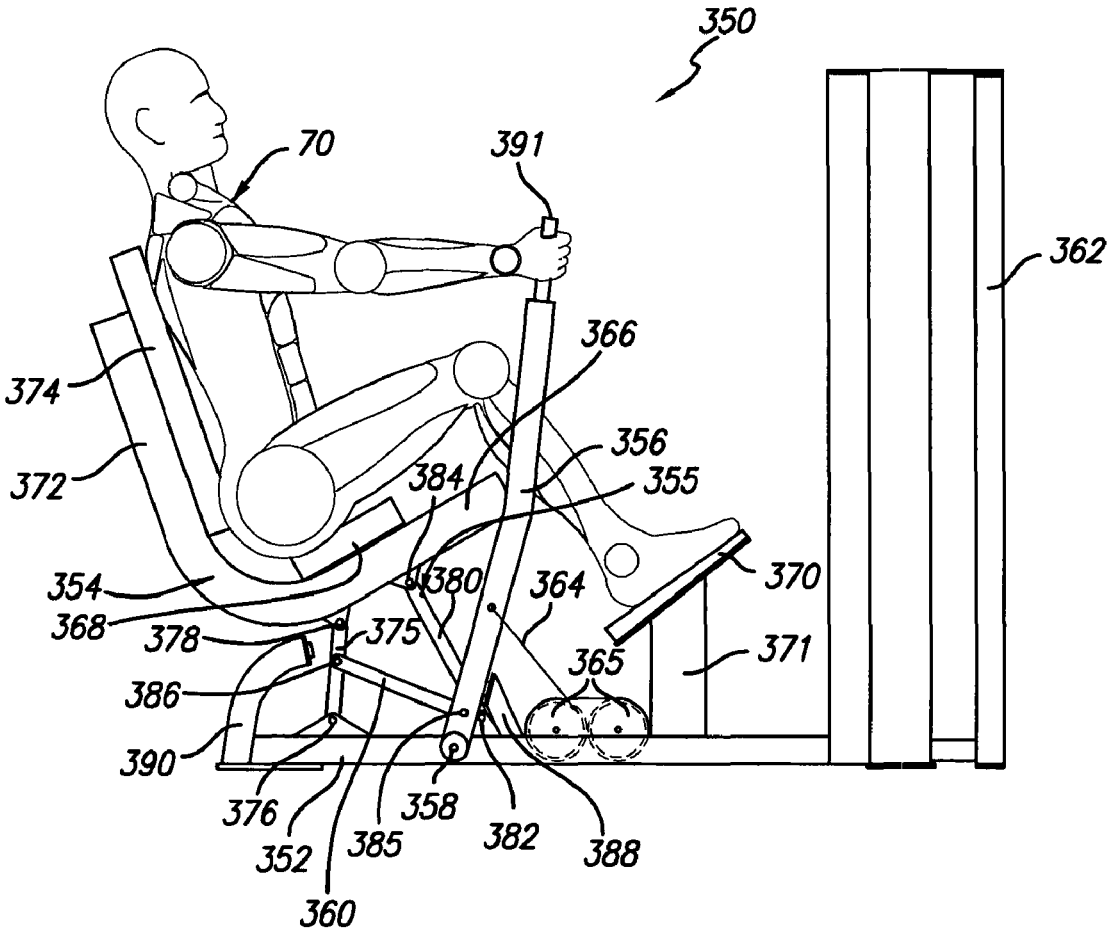
FIG. 7 is a side elevation view of a mid-row exercise machine according to another embodiment, with a user seated on the machine in the start position adopted at the beginning of the exercise.
Figure 8:
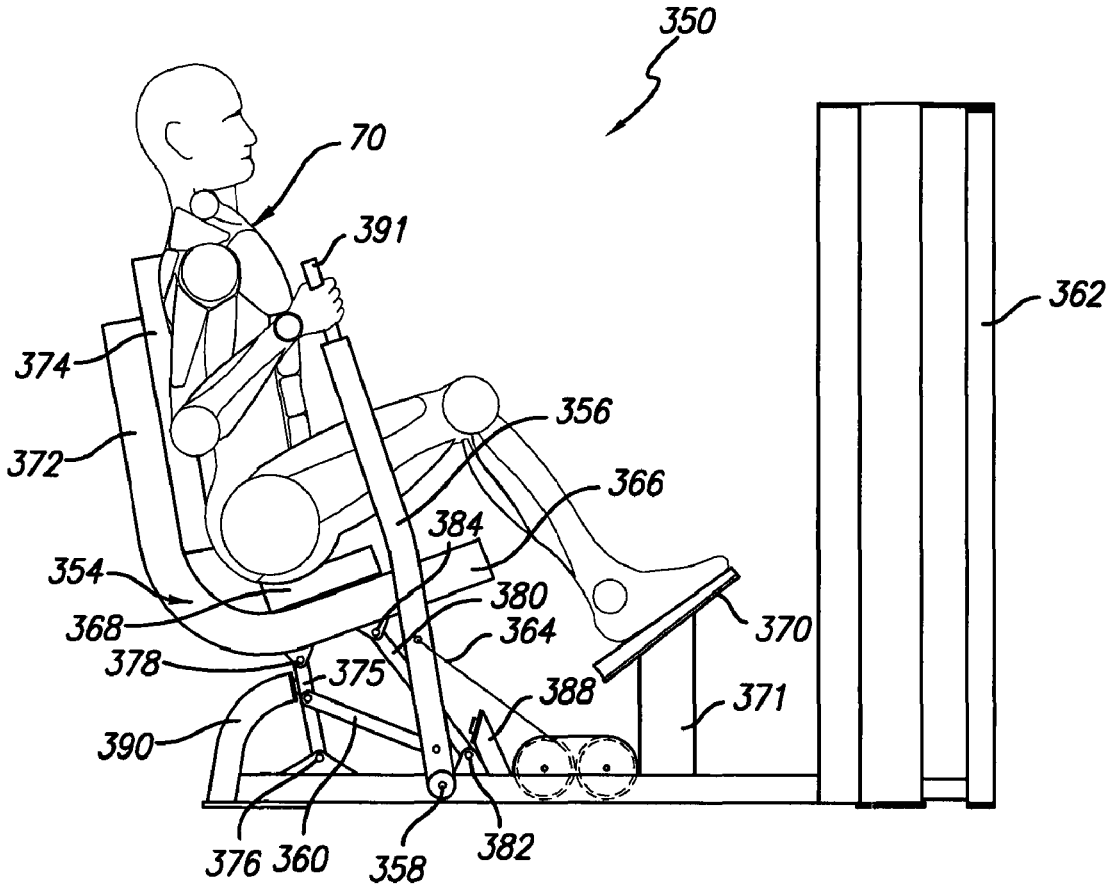
FIG. 8 is a side elevation view of the mid-row exercise machine of FIG. 7 with the user and machine in the end position of the exercise.
Figure 9:
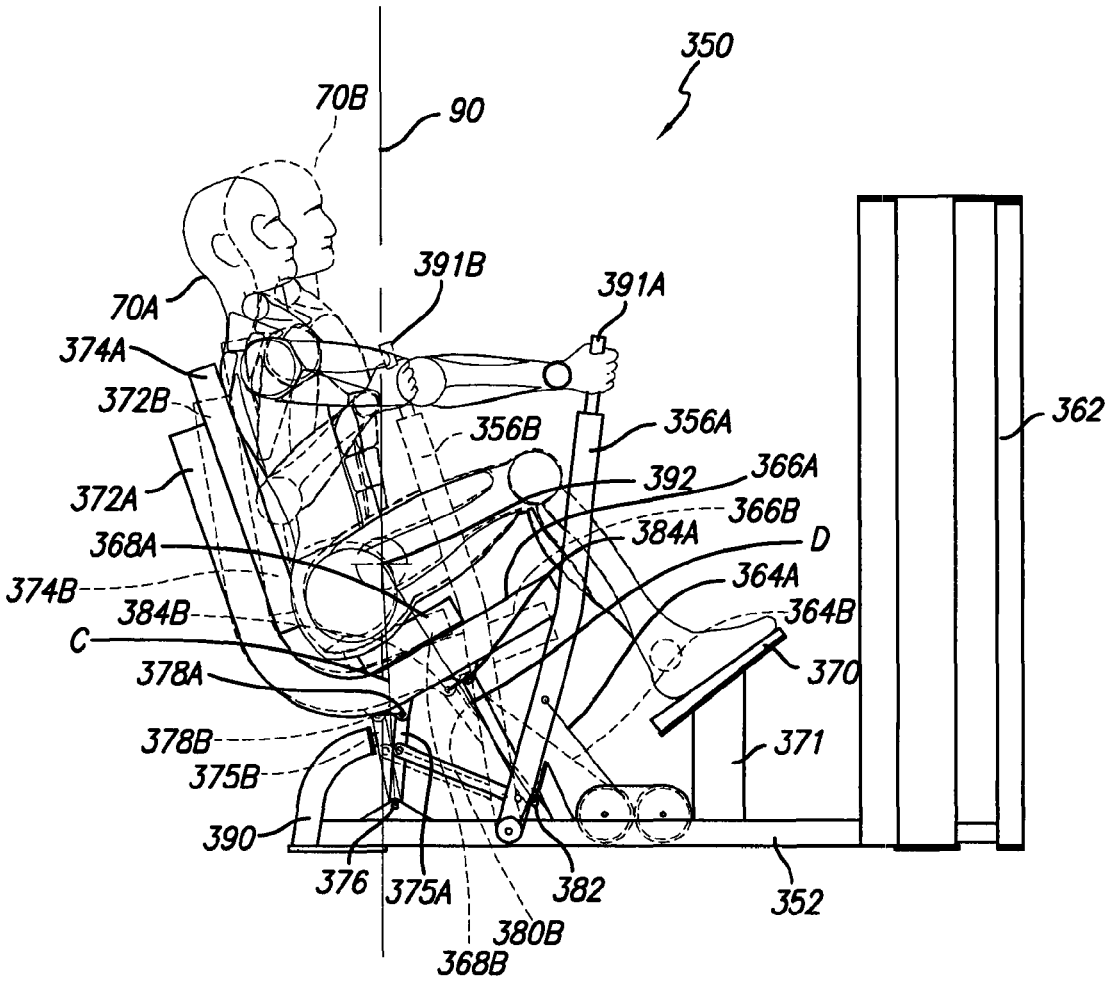
FIG. 9 is an overlapping side elevation view illustrating the start and end positions of FIGS. 7 and 8 superimposed.

FIGS. 7 to 9 illustrate a rowing or mid-row exercise machine 350 according to a third embodiment, comprising a main frame having a base 352, a user support frame 354 pivotally mounted on the main frame base 352 via a four bar pivot system 355, and a user engagement device or exercise arm 356 pivotally mounted on the main frame base 352 for rotation about pivot axis 358. Movement of the user engagement device 356 is translated into movement of the user support via a connecting linkage which in this case comprises a connecting link 360 pivoted between the user engagement device or exercise arm 356 and one of the links of the four bar pivot system 354, as explained in more detail below. User engagement device or exercise arm 356 is linked to a user selected amount of weight in a weight stack (not illustrated) in weight stack housing 362 at the forward end of the main frame, via a load bearing cable 364 extending from arm 356 between dual pulleys 365 at the base of the frame and then forward to the weight stack.

The user support frame 354 is similar to the previous embodiments except that the base 366 does not extend as far forward from seat pad 368 and has no foot plate or plates secured at its forward end. Instead, footrests 370 which support the user's feet are mounted on the upper end of a vertical post 371 on the base 352 of the main frame in front of the user support, and remain stationary throughout the exercise movement. As in the previous embodiments, the user support frame has a rear portion 372 which extends generally upwardly from the base, and on which a back rest or back pad 374 is mounted to support the user's back.

The four bar pivot system 355 which pivotally mounts the user support frame on the base of the main frame has first and second spaced bars or pivot links 375, 380 each pivoted between the base 352 of the main frame and the base 366 of the user support. The first bar or pivot link 375 is pivoted at one end to the base 352 for rotation about first pivot axis 376 and at the other end to the underside of the base 366 of the user support for rotation about second pivot axis 378. A second bar or pivot link 380 is pivoted at one end to the base 352 of the main frame at a location spaced forward of pivot axis 378, for rotation about third pivot axis 382. The upper end of pivot link 380 is pivoted to the underside of the user support base for rotation about fourth pivot axis 384 which is spaced forward from the second pivot axis 378.

The connecting link 360 is pivoted at its forward end to the exercise arm 356, for rotation about pivot axis 385 which is close to the lower end of arm 356, and is pivoted at its rear end to the first or rear pivot link 375 of the four bar pivot system, for rotation about pivot axis 386. A first end stop at the upper end of post 388 on the main frame engages the exercise arm 356 in the start position of an exercise, as seen in FIG. 7. A second end stop at the end of post 390 at the rear end of the main frame base 352 engages the rear pivot link 375 of the four bar user support pivot system in the end position of an exercise, as seen in FIG. 8.

The user engagement device 356 may comprise separate, independently movable exercise arms or a U-shaped exercise arm as in the first embodiment which is pivoted to the main frame at the base of the U-shape for rotation about pivot axis 358. Handles or grips 391 are provided at the upper end of each exercise arm or upright exercise arm portion.

As noted above, FIG. 7 illustrates a user seated on the machine 350 in the start position for a mid-row exercise, while FIG. 8 illustrates the user and machine in the end position of the exercise. In order to perform a mid-row exercise, the user sits on user support seat 368 with their back against back pad 374, and reaches forward to grab the handles 391 of the user engagement device or exercise arms 356. This is the position illustrated in FIG. 7. The user then pulls the handles 391 inward towards their chest, stopping when the handles reach the end position of FIG. 8, just in front of their chest and slightly below shoulder level.

In moving from the start position of FIG. 7 to the end position of FIG. 8, the seat pad 364 and back pad 374 of the user support move from the rearwardly reclined position illustrated in FIG. 7, pivoting forwardly via the four-bar pivot linkage to a less rearwardly reclined position as illustrated in FIG. 8. The four-bar pivot linkage defines a theoretical pivot of the pivoting movement, as illustrated in FIG. 9. In FIG. 9, the start and end positions of the exercise movement are superimposed in order to illustrate the theoretical pivot location 392 and how different parts of the machine are oriented in the finish position relative to the start position. The parts which move are designated with an A in the start position and a B in the finish position. The two pivots 376 and 382 of the links 375 and 380 to the main frame are fixed, while the pivots 378 and 384 travel from positions 378A and 384A to positions 378B and 384B, respectively. FIG. 9 illustrates the plotting of the theoretical pivot point 392 for the user support. The theoretical pivot point 392 is at the point of intersection of the centerlines C, D of the arcing movement for each link 375, 380 of the user support four-bar pivot system. From this point we can determine the gravitational centerline 90 of the pivoting movement, which is shown as a dotted vertical line. The first centerline C extends from pivot 376 through the center of a line connecting the start and end position 378A, 378B of pivot 378, and the second centerline D extends from fixed pivot 382 through the center of a line connecting the start and end positions 384A, 384B of pivot 384. It can be seen from this drawing that it would be difficult and more expensive to duplicate the pivoting movement of the user support provided by four-bar pivot linkage 355 with a single pivot mount, since this would require an actual pivot at point 392.

During the exercise motion, the angle of the user support seat 368 goes from more rearwardly reclined to less rearwardly reclined, because movement in the four-bar pivot system dips the front end of the user support seat 368 as it raises the rear end. It also shifts the pad rearward slightly (compare pad positions 368A and 368B in FIG. 9). This combined action moves slightly more of the user onto the resistance side of the gravitational centerline, since the user's body is rotated slightly forward.

In the exercise machine of this embodiment, the theoretical pivot axis 392 of the pivotal movement is just forward of the user's hip, while the four-bar pivot system 355 is positioned under the exerciser. The gravitational centerline 90 of the pivotal movement runs forward of the centerline of the user's hip, and a balanced portion of the user and user support is positioned on each side of the gravitational centerline in both the start and end position. In this embodiment, the positioning of the exerciser's hands relative to their shoulders is slightly higher in the starting position than the finish position. This involves more of the back muscles and combines multiple lat pull movements in one exercise, which is not possible with a conventional rowing machine exercise using a cable.

Figure 10:
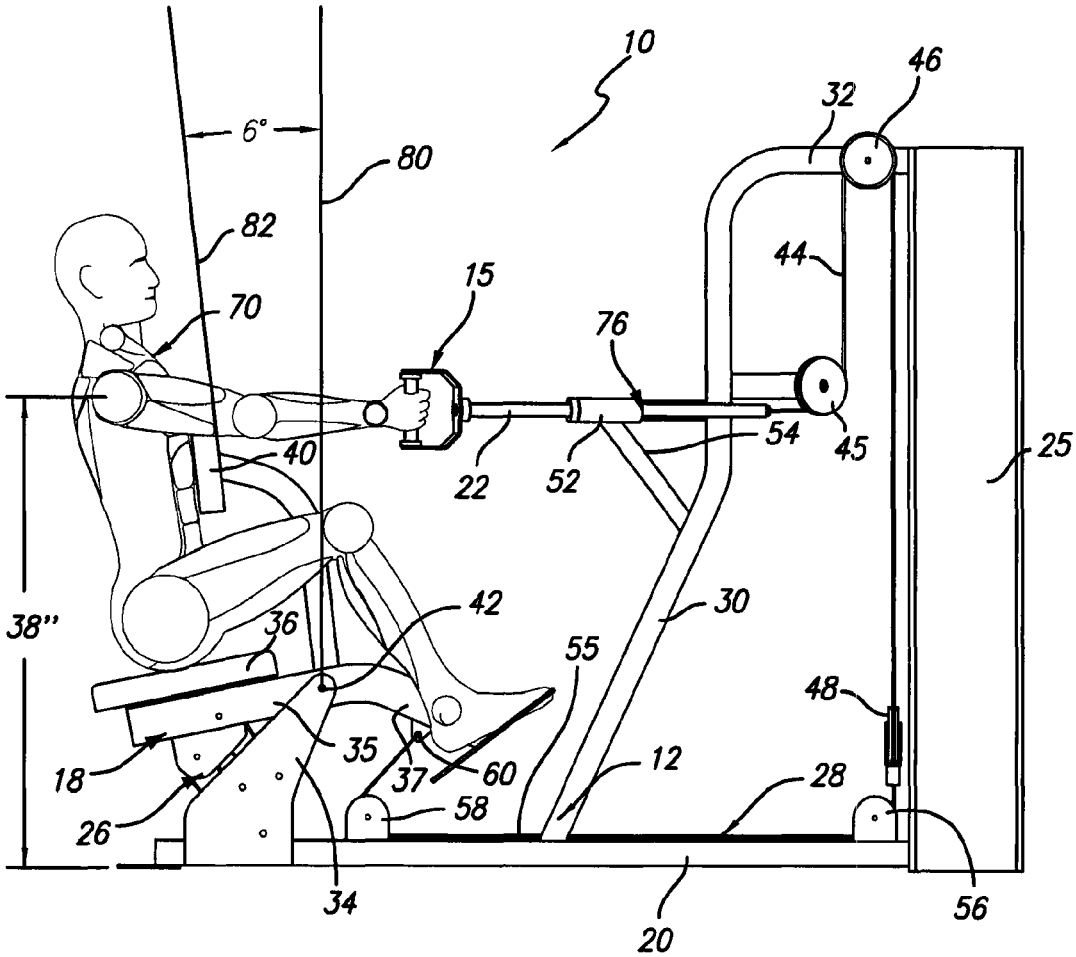
FIG. 10 is a side elevation view of another embodiment of a mid-row exercise machine in an exercise start position with a user seated on the machine.
Figure 11:
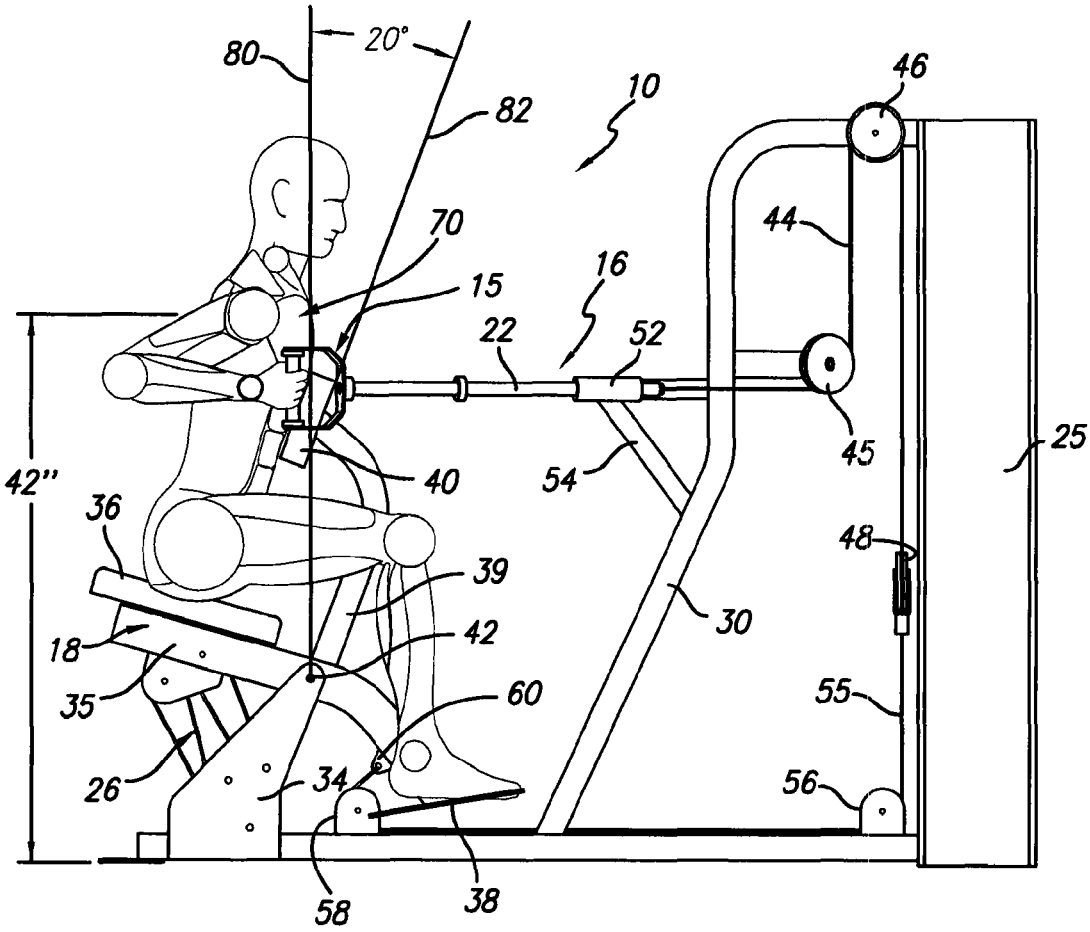
FIG. 11 is a side elevation view similar to FIG. 10 but illustrating the end position of the exercise.
Figure 12:
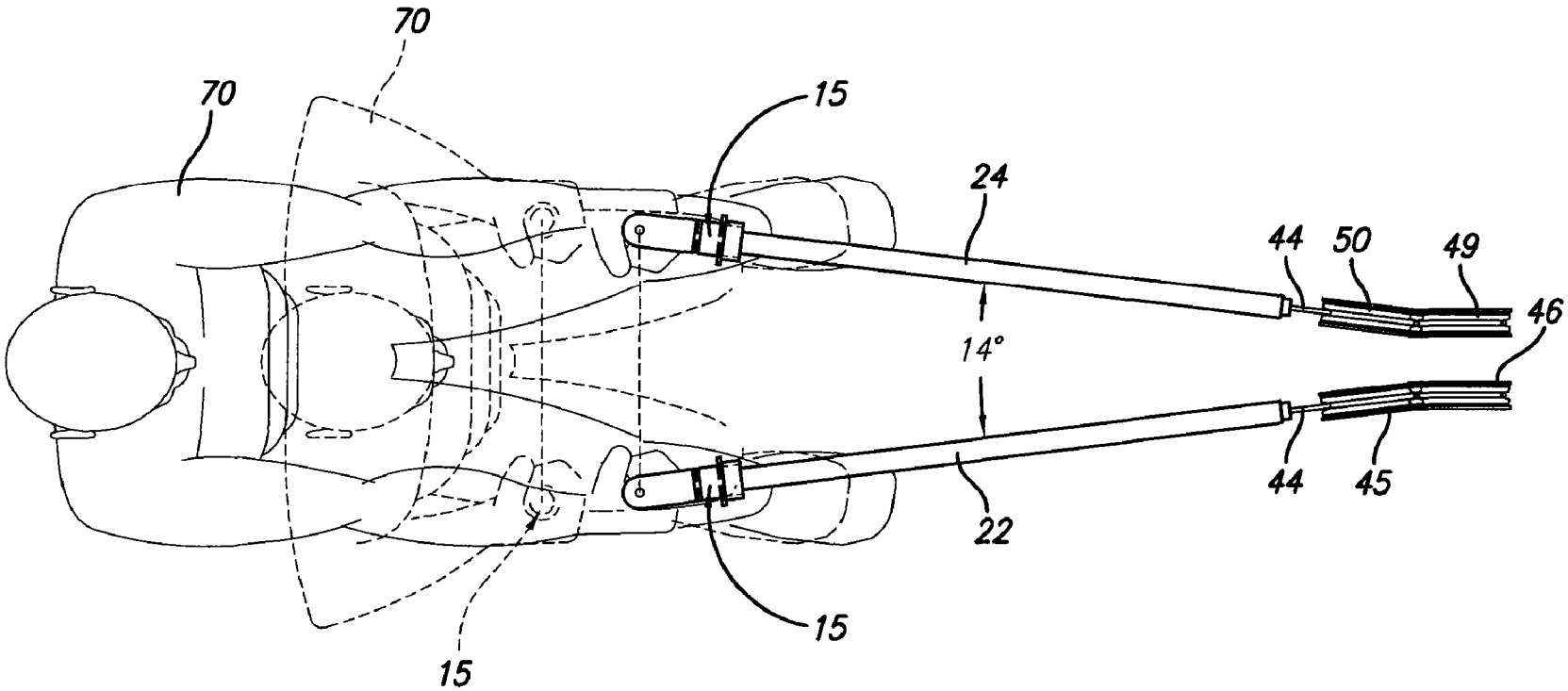
FIG. 12 is a top plan view of the user and the user engaging handle part of the machine of FIGS. 10 and 11 with the start and end position of the user and user engaging handles shown superimposed.
Figure 13A:
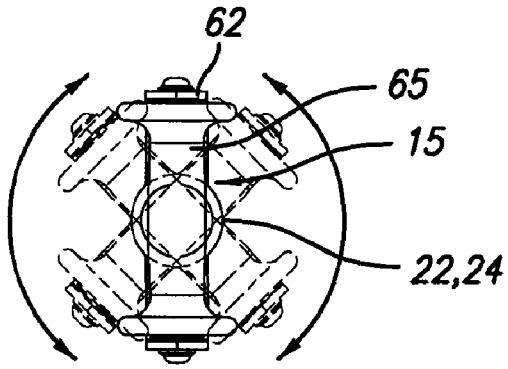
FIG. 13A is an end elevation view of one of the handles of the machine of FIGS. 10 to 12 illustrating adjustment of the hand grip orientation.
Figure 13B:
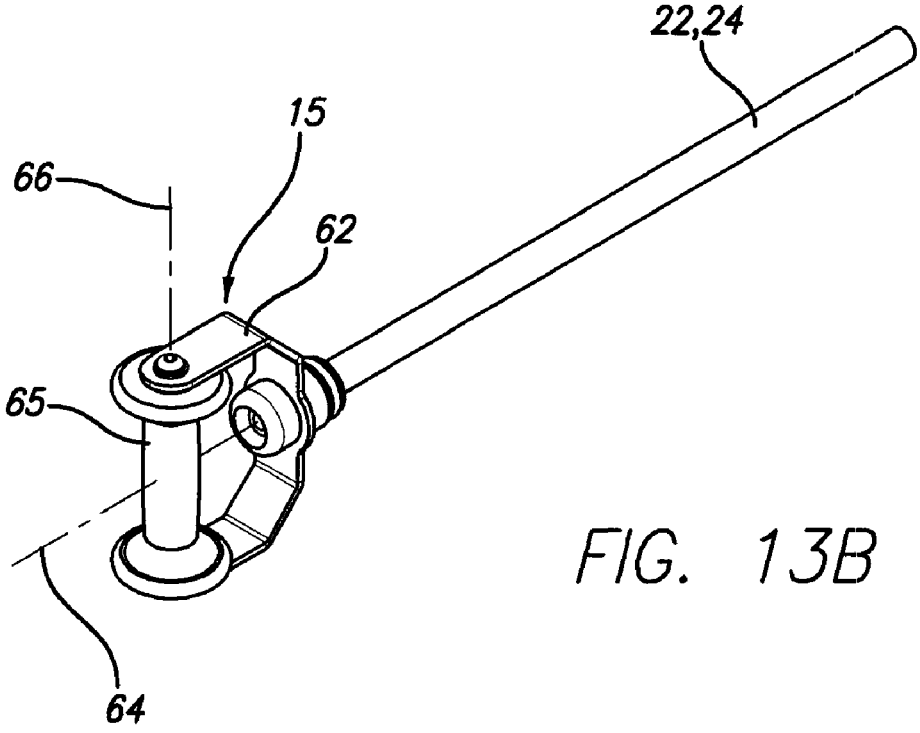
FIG. 13B is a perspective view of a handle arm of the machine of FIGS. 10 to 12, illustrating the perpendicular pivot axes of the articulating handle.

FIGS. 10 to 12 illustrate a rowing or mid-row exercise machine 10 according to another embodiment with a user 70 positioned on the machine to perform a mid-row exercise, while FIGS. 13A and 13B illustrate one of the articulating handles 15 of the user engagement device 16 of this machine. Machine 10 has a main frame 12, a user support frame 18 pivotally mounted on the main frame, a user engagement device 16 having independent exercise arms 22, 24, and an exercise resistance comprising a weight stack in housing 25 linked to the user support frame 18 via cable and pulley assembly 26, only part of which is visible in the drawings. The user engagement device 16 is linked to the user support frame by a connecting linkage 28 so that pulling on the handles 15 in a rowing exercise is translated into movement of the user support frame, as described in more detail below.

Main frame 12 has a horizontal base 20, an upwardly extending portion 30 with a generally horizontal section 32 at its upper end, and a pair of pivot mounting plates 34 extending upwardly from the frame adjacent its rear end. The user support frame 18 has a base 35 with a user support seat or pad 36 at its rear end and a downwardly extending forward end portion 37 having a foot plate or plates 38 secured at its lower end. An upright member 39 extends upwardly from the base 35 at a location in front of the user support seat 36, and has a rearwardly curved upper portion with a chest pad 40 mounted at its end for engaging the chest of a user 70 during the exercise. The pivot mounting plates support pulleys (not visible) of the load engaging cable and pulley assembly 26 which is located beneath the user support seat 36, and are pivotally connected to the base 35 of the user support frame at a location spaced forward from the seat and under post 39, to allow rotation of the user support frame about pivot axis 42.

The user engagement device 16 in this embodiment is partly rigid and partly flexible, and comprises right and left rigid exercise arms or arm portions 22, 24 (see FIG. 12) each having an articulated handle 15 secured at one end for engagement by a user's hands, and a flexible elongate member such as a cable 44 which runs around a series of pulleys and extends between arms 22, 24. The cable 44 has a first end anchored to the end of arm 22 and runs around a first outwardly angled pulley 45 on the upwardly extending portion 30 of the main frame, around a pulley 46 on the upper horizontal section 32 of portion 30, and then downwardly around a floating pulley 48. The cable 44 then runs upwardly around a fixed pulley 49 (see FIG. 12) mounted on upper horizontal section 32 of the main frame behind pulley 46, then back down and around a second outwardly angled pulley 50 on the upwardly extending portion 30 of the main frame (see FIG. 12) before anchoring to the end of arm 24. Each of the rigid exercise arms 22, 24 extends through a respective guide tube 52, only one of which is visible in FIGS. 10 and 11. Guide tubes 52 are supported on the upright portion 30 of the main frame by angled support struts 54, and are each angled in alignment with the respective outwardly angled pulley 45, 50 to define diverging linear paths for the two arms 22, 24, as best seen in FIG. 12. The exercise arms diverge from one another at an angle of around 14 degrees in this embodiment, as shown in FIG. 12.

The connecting linkage 28 comprises a cable and pulley assembly having a cable 55 extending from the housing of floating pulley 48 around a first pulley 56 mounted on the base 20 of the main frame adjacent the weight stack housing and a second pulley 58 mounted on the base 20 at a location spaced from the first pulley and beneath the user support frame. Cable 55 is then anchored to a cable anchor 60 on the lower side of the user support base 35, at a location on the downwardly extending, forward end portion of base 35. Thus, in this embodiment, the connecting linkage comprises a flexible link extending from the user engagement device around pulleys on the main frame before connecting to a forward end portion of the base of the user support frame.

The articulating handles 15 allow the user to change their hand position as needed throughout the exercise. As best illustrated in FIGS. 13A and 13B, each handle 15 comprises a generally C-shaped bracket 62 pivotally connected at its center to the end of the respective exercise arm 22, 24 for rotation about a first pivot axis 64 aligned with the longitudinal axis of the respective exercise arm. A hand grip 65 is pivotally mounted between the ends of the C-bracket 62 for rotation about its axis 66. These handles allow for multiple grip positions as indicated by the arrows and dotted line positions in FIG. 13A, and permit the user to self-align their wrist to the movement pattern.

In order to perform the exercise, the user 70 first sits on the user support pad 36 in the position of FIG. 10 and the solid line position of FIG. 12, placing their feet on the footplate 38 and their chest against the chest pad 40, then grabs the grips 65 of handles 15 with their arms straight in front of their body, slightly bent, and their hands relatively close together, as indicated in solid lines in FIG. 12. At the start of the exercise, the user is in a slightly reclined orientation at an angle of around 6 degrees to the gravitational centerline 80 extending through user support pivot 42, as indicated in FIG. 10, where the second dotted line 82 indicates the orientation of the chest pad 40 or front of the user's chest at the start of the exercise.

From the position illustrated in FIG. 10, the user pulls the handles or hand grips 15 rearward towards their chest, so that the exercise arms 22, 24 travel rearward and outward on divergent linear paths, as indicated by the dotted line end position in FIG. 12. Rearward movement of the exercise arms pulls the ends of cable 44, lifting the floating pulley 48 and also pulling the connecting linkage cable 55 to rotate the user support downwardly at its forward end and upwardly at its rear end against the exercise resistance, with the chest pad and user upper body ending up in a forward lean of around 20 degrees from the vertical, as seen in FIG. 11. The user support seat pad 36 is inclined downward in the end position of the exercise. The user's arms finish in a bent position with their hands positioned adjacent opposite sides of their chest, slightly below and forward of their shoulders. The user's hands therefore diverge during the exercise movement, starting at a spacing of about 12 inches and ending at a wider spacing of around 13 inches in the illustrated embodiment.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. These factors together provide an enhanced workout by involving a greater number of muscles than a mid-row exercise performed in only one position.

The gravitational centerline or vertical centerline 80 of the user support pivot runs through the exerciser's thigh, just behind the knee in the start position and ending at mid thigh in the end position of the mid-row exercise. There is a balanced distribution of weight on each side of the centerline 80 of the pivotal movement both at the start and end position, minimizing the effect that the weight of the exerciser and user support has on the exercise resistance. The amount of weight positioned on each side of centerline 80 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

In each of the above embodiments, the connecting linkage translates movement of the user engagement device to the user support. The connecting linkage may be movably engaged with at least two of the main frame, user engagement device, and user support. In some embodiments, such as the embodiments of FIGS. 5 and 6 and 10 to 12, the connecting linkage is associated with all three of the user engagement device, user support, and main frame. The connecting linkage may have multiple parts or comprise a single rigid link, articulated links, completely flexible links, a sliding wedge link or rolling carriage, and the like, and the connecting linkage may be made adjustable.

The user engagement device may have linked or separate exercise arms moveable in straight, parallel paths or in slightly diverging straight paths during an exercise, or may be a pivotally mounted exercise arm. The exercise arm or arms may be movably mounted on the main frame, connecting linkage, or user support frame, and may be rigid or partially flexible. The handles may be rigid or flexible, and may provide for two-dimensional or three-dimensional hand movement.

In each of the above embodiments, movement of the user support is linked to movement of the exercise arm or user engagement device, and the gravitational centerline of the user support's pivotal movement is positioned so that the combined weight of the user support and user is distributed on both sides of the gravitational centerline in at least one of the exercise start and end positions. Because of this arrangement, the user support provides a counter-balancing effect on the exercise arm as it moves and its weight is re-distributed. This balanced weight distribution positions a portion of the user and user support on each side of the gravitational centerline in either the start or end position, or both the start and end position. As the exercise arm is moved, a portion of this combined weight passes through the gravitational centerline redistributing the weight. This re-distribution is gradual and continuous throughout the exercise motion and is not noticed by the user.

In the exercise machines described above, operation of the user engagement device causes a rocking movement of the user support. Due to the position of the user support pivot or the theoretical pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the various embodiments may be mixed and interchanged with one another, and different types and forms of components could be used without affecting the scope of the invention. Cables could be replaced with belts, ropes, chains, or the like, and pulleys could be replaced with sprockets. The seat and/or back pad could be fixed or made adjustable. Various different types of user engaging pads can be used. The exercise arm or user engagement device could be unidirectional or bi-directional, and may be in one piece (dependent) or two pieces for independent arm movement. The exercise arm may be mounted on the user support, main frame, or connecting linkage, and the exercise arm movement may be rotational or linear.

The user support and user engagement device could be designed to travel in the same or opposite directions. The user support pivot mount may have a single pivot or multiple pivots, and in the latter case the user support pivots about a theoretical pivot mount of the combined pivotal motion. Any of the various embodiments could have the resistance associated with any of the moving parts (user support, user engagement device, or connecting linkage). The exercise resistance may be a weight stack linked to part of the apparatus by a cable and pulley arrangement, or may be weight plates. Any other type of resistance known in the art may alternatively be used, such as hydraulic, pneumatic, electromagnetic, or elastic bands, in place of the weight stack or weight plates.

Although the exercise machine described above is a single, stand-alone exercise station, it may be incorporated as one of the exercise stations in a multi-station exercise machine. The multiple user supports provide secure and safe positioning, placing the user in the proper exercise alignment from start to finish, without any adjustment required by the user. The seat and upper body support (chest pad or back pad) travel together in fixed alignment to keep the user in the same position throughout the exercise motion so that the user does not have to worry about balancing on a moving platform or pad. Additional supports or foot plates which also travel with the user support provide a rest for the user's feet during travel of the user support, for added stability.

In each case, the user support is positioned relatively low to the ground in the start and end position, making the machines quicker, easier, and safer to enter and exit. The user does not have to climb up or down in order to get into, or out of, the exercise position. The low profile also makes the machines more economical to produce and less intimidating to the user. The user's position is continuously adjusted throughout the exercise from a slight rearward lean, through an upright position, and ending in a forward lean. This results in involvement of more back muscles than would be involved in a corresponding pulling exercise where the exerciser remained in the same position throughout the exercise. The combined exercise arm and user support movement produces an automatic and continuous self-aligning exercise motion that allows enhanced hand and wrist positioning versus free weight and free bar exercises or prior art machines for performing equivalents of such exercises.

The user support has both a primary user support and a secondary user support which travel together during the exercise movement, and also has an additional user support in the form of a foot plate or foot rests to provide additional stabilization. This helps to maintain a proper exercise position throughout the exercise so that the user feels secure on the moving user support.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A mid-row exercise machine, comprising:

a floor-engaging main frame having a forward end and a rear end;

a user support frame pivotally associated with the main frame and movable between a start position and an end position during an exercise, the user support frame moving about a user support pivot axis in one direction between an exercise start position and an exercise end position during an exercise movement;

the user support frame having at least a primary support and a secondary support for supporting spaced positions on a user's body throughout an exercise movement, the primary support supporting the majority of a user's weight in the start position of the support frame, and the secondary support being secured at a fixed angular orientation relative to the primary support and not moving relative to the primary support as the user support frame travels between the exercise start and end positions during the exercise movement;

a user engagement device movably mounted relative to the frames and having at least one hand grip for gripping by a user positioned on the user support, the user engagement device being movable in a mid-row, pulling exercise movement path between a start position in which the hand grip is at a first position spaced in front of at least one of the primary and secondary supports, and an end position spaced rearwardly from the first position closer to said at least one support;

a connecting linkage which translates pulling movement of the user engagement device to movement of the user support frame; and a load for resisting movement of at least one of the user support, user engagement device, and connecting linkage;

whereby the combined motion of the user, user support, and user engagement device substantially replicates the natural movement of the upper part of a human body when performing a rowing exercise.

2. The machine of claim 1, wherein the user support frame supports a user in a seated position, the primary support comprises a seat pad and the secondary support comprises an upper body engaging pad.

3. The machine of claim 2, wherein the secondary support comprises a back pad.

4. The machine of claim 2, wherein the secondary support comprises a chest pad.

5. The machine of claim 2, wherein the user support frame further comprises an additional support which supports a different part of a user's body from the seat pad and upper body enaging pad.

6. The machine of claim 5, wherein the additional support comprises a foot support for the user's feet.

7. The machine of claim 6, wherein the foot support is rigidly secured to the user support frame at a predetermined, fixed orientation relative to the primary and secondary supports and not moving relative to the primary and secondary support as the user support frame travels between the start and end positions throughout an exercise.

8. The machine of claim 6, wherein the foot support is rigidly secured to the main frame in front of the user support frame and at a predetermined, fixed orientation relative to the main frame.

9. The machine of claim 1, further comprising a single pivot connection pivotally connecting the user support frame to the main frame and located beneath the user support frame.

10. The machine of claim 1, further comprising a four-bar pivot system pivotally connecting the user support frame to the main frame.

11. The machine of claim 1, wherein the user engagement device is movable in a linear path relative to the frames.

12. A mid-row exercise machine, comprising:

a floor-engaging main frame having a forward end and a rear end;

a user support frame pivotally associated with the main frame and movable between a start position and an end position during an exercise;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames and having at least one hand grip for gripping by a user positioned on the user support, the user engagement device being movable in a mid-row exercise movement path between a start position in which the hand grip is at a first position spaced in front of the chest of a user positioned on the user support, and an end position spaced rearwardly from the first position closer to the user's chest;

a connecting linkage which translates movement of the user engagement device to movement of the user support frame;

a load for resisting movement of at least one of the user support, user engagement device, and connecting linkage;

whereby the combined motion of the user, user support, and user engagement device substantially replicates the natural movement of the upper part of a human body when performing a rowing exercise;

the user engagement device being movable in a linear path relative to the frames and comprising a pair of exercise arms slidably moveable relative to the main frame in diverging linear paths between the start and end positions, each arm having a hand grip for gripping by the user and the hand grips being closer together in the start position than the end position of an exercise.

13. The machine of claim 1, wherein the connecting linkage comprises a moving carriage member slidably engaged with the main frame and associated with user support frame.

14. The machine of claim 13, wherein the moving carriage member is slidably engaged with both the main frame and the user support frame.

15. The machine of claim 13, wherein the connecting linkage further comprises a link member pivotally linking the sliding carriage with the user support frame.

16. The machine of claim 13, wherein the user engagement device is secured to the moving carriage member and is slidable with the carriage member relative to the frames.

17. The machine of claim 13, wherein the user engagement device is pivotally mounted on the main frame and linked to the moving carriage member.

18. The machine of claim 1, wherein the user engagement device comprises first and second hand grips and first and second arm portions extending from the respective hand grips and associated with at least one of the main frame, user support frame, and connecting linkage, each arm portion being non-rigid along at least part of the length of the arm portion.

19. The machine of claim 18, wherein each arm portion has a first, rigid part extending from the respective hand grip, and an elongate flexible part extending from the rigid part to the connecting linkage.

20. A mid-row exercise machine, comprising:

a floor-engaging main frame having a forward end and a rear end;

a user support frame pivotally associated with the main frame and movable between a start position and an end position during an exercise;

the user support frame having at least a primary support and a secondary support for supporting spaced positions on a user's body throughout an exercise movement, the secondary support being fixed at a predetermined angular orientation relative to the primary support, the primary support supporting the majority of a user's weight in the start position of the support frame:

a user engagement device movably mounted relative to the frames and having at least one hand grip for gripping by a user positioned on the user support, the user engagement device being movable in a mid-row exercise movement path between a start position in which the hand grip is at a first position spaced in front of the chest of a user positioned on the user support, and an end position spaced rearwardly from the first position closer to the user's chest;

a connecting linkage which translates movement of the user engagement device to movement of the user support frame;

a load for resisting movement of at least one of the user support, user engagement device, and connecting linkage;

whereby the combined motion of the user, user support, and user engagement device substantially replicates the natural movement of the upper part of a human body when performing a rowing exercise;

the user engagement device comprising first and second hand grips and first and second arm portions extending from the respective hand grips and associated with at least one of the main frame, user support frame, and connecting linkage, each arm portion being at least partially non-rigid;

each arm portion having a first, rigid part extending from the respective hand grip, and a flexible part extending from the rigid part to the connecting linkage; and the flexible part comprising at least one cable extending between the rigid parts of the two arm portions and associated with the connecting linkage between the rigid arm parts.

21. The machine of claim 1, wherein the hand grip has a first portion rotatable about a first axis and a second, gripping portion rotatable relative to the first portion about a second axis perpendicular to the first axis.

22. The machine of claim 1, wherein the user engagement device comprises first and second rigid exercise arms rotatable relative to the frame about a common pivot axis, each exercise arm having a hand grip for gripping by a user positioned on the user support frame.

23. The machine of claim 22, wherein the exercise arms are joined to move together in an exercise movement.

24. The machine of claim 22, wherein the exercise arms are independently movable.

25. The machine of claim 1, wherein the primary support comprises a seat pad, and the end position of the seat pad is at a different angular orientation relative to the start position.

26. The machine of claim 25, wherein the seat pad is forwardly inclined in the start position and rotates rearwardly from the forwardly inclined position during an exercise.

27. The machine of claim 26, wherein the seat pad is rearwardly reclined in the end position.

28. The machine of claim 25, wherein the seat pad is rearwardly reclined in the start position and rotates forwardly from the rearwardly reclined start position during an exercise.

29. The machine of claim 28, wherein the seat pad is in a less rearwardly inclined orientation in the end position than in the start position.

30. The machine of claim 28, wherein the seat pad is forwardly inclined in the end position.

31. The machine of claim 1, wherein the user engagement device and user support frame move in opposite directions during an exercise.

32. The machine of claim 1, wherein the user engagement device and user support frame move in the same direction during an exercise.

33. A rowing exercise machine, comprising:

a floor-engaging main frame having a front end and a rear end;

a user support frame;

a pivot assembly pivotally mounting the user support frame relative to the main frame and adapted to define a rotation path of the user support frame about the pivot assembly between a start position and an end position of an exercise movement, the pivot assembly having at least one pivot and defining a vertical gravitational center line of the pivotal movement of the user support frame;

the user support frame adapted to support a user in an exercise position facing the front end of the main frame, the user support frame having at least a primary support and a secondary support for supporting spaced positions on a user's body throughout an exercise movement, the primary support supporting the majority of a user's weight in the start position of the support frame, and the secondary support being secured at a fixed angular orientation relative to the primary support and not moving relative to the primary support as the user support frame travels between the exercise start and end positions during the exercise movement;

a user engagement device movably mounted in front of at least the primary support of the user support frame for movement relative to one of the frames, the user engagement device having at least one partially rigid portion having a hand grip engaged by the user in performing rowing exercises and adapted to move in an exercise path between exercise start and end positions;

a connecting linkage which translates movement of the user engagement device to movement of the user support frame; and a load for resisting movement of at least one of the user support, user engagement device, and connecting linkage.

34. The machine of claim 33, wherein the gravitational center line of the user support pivotal motion is positioned such that portions of the combined weight of the user and user support frame are distributed on each side of the gravitational center line of the pivotal motion in at least one of the start and end position and only a portion of the combined weight passes through the gravitational center line during the exercise movement.

35. The machine of claim 33, wherein the user support frame has a seat pad which supports a user in a seated position and the gravitational center line extends through the seat pad in at least one of the start and end position of an exercise movement.

36. The machine of claim 33, wherein the user support frame has a base and a seat pad on the base which supports a user in a seated position, and the gravitational center line extends through the base of the user support frame.

37. The machine of claim 33, wherein the user support frame has a base, the primary user support comprises a seat pad on the base which supports a user in a seated position, and the user support pivot assembly is associated with the base of the user support frame.

38. The machine of claim 37, wherein the main frame has a base and the user support pivot assembly comprises a four bar pivot linkage between the bases of the user support frame and the main frame.

39. The machine of claim 37, wherein the user support pivot assembly further comprises a pivot mount on the main frame and said pivot comprises a pivot connection between the pivot mount and the base of the user support frame.

40. The machine of claim 33, wherein the user support frame further comprises an additional support spaced from the primary and secondary supports and supporting a spaced position on a user's body.

41. The machine of claim 33, wherein the secondary support comprises a foot support for the user's feet and no part of the foot support is moveable relative to the primary support.

42. The machine of claim 33, wherein the user engagement device has two partially rigid portions each having a hand grip engaged by the user when performing a rowing exercise.

43. A rowing exercise machine, comprising:

a floor-engaging main frame having a front end and a rear end;

a user support frame;

a pivot assembly pivotally mounting the user support frame relative to the main frame for rotation about a user support pivot axis, the pivot assembly adapted to control rotation of the user support frame along an exercise path between a start position and an end position during an exercise movement, the pivot assembly having at least one pivot and defining a vertical gravitational center line of the pivotal movement of the user support frame which extends through the user support pivot axis;

the user support frame supporting a user in a rowing exercise position facing the front end of the frame and having at least a primary support and a secondary support for supporting spaced positions on a user's body throughout an exercise movement, the primary support supporting the majority of a user's weight in the start position of the support frame, and the entire secondary support being secured at a fixed angular orientation relative to the primary support and no part of the secondary support moving relative to the primary support as the user support travels between the exercise start and end positions during the exercise movement;

a user engagement device movably mounted relative to the frames and having at least a first exercise arm having a hand grip engaged by the user positioned on the user support frame when performing a rowing exercise, the exercise arm having a rigid portion extending from the hand grip along at least part of the length of the arm, the user engagement device being movable in a pulling exercise movement path between a start position in which the hand grip is at a first position spaced in front of at least one of the primary and secondary supports, and an end position spaced rearwardly from the first position closer to said at least one support;

a connecting linkage associated with at least two of the main frame, user support frame, and user engagement device which is adapted to translate a pulling movement of the user engagement device to movement of the user support frame along the exercise path;

a load for resisting movement of at least one of the user support, user engagement device, and connecting linkage; and the gravitational center line of the user support pivotal motion being positioned such that portions of the combined weight of the user and user support frame are distributed on each side of the gravitational center line of the pivotal motion in at least one of the start and end position and only a portion of the combined weight passes through the gravitational center line during the exercise movement.

44. The machine of claim 43, wherein portions of the combined weight of the user and user support frame are distributed on both sides of the gravitational center line in both the start and end position of a rowing exercise.

45. The machine of claim 43, wherein the exercise arm is rigid along its entire length.

46. The machine of claim 43, further comprising a second exercise arm having a hand grip engaged by the user and a rigid portion extending from the hand grip along at least part of the length of the second exercise arm.

47. The machine of claim 46, wherein the exercise arms are positioned on the opposite sides of the user support frame, and the hand grips move in parallel paths during an exercise movement and are at the same spacing in the start and end positions.

48. The machine of claim 46, wherein the hand grips move in divergent paths during an exercise movement and are spaced farther apart in the end position than in the start position.

49. The machine of claim 46, wherein both exercise arms are rigid along their entire length and have lower ends which are connected together and movably mounted relative to the main frame.

50. The machine of claim 46, wherein the exercise arms are pivotally mounted on the main frame.

51. A rowing exercise machine, comprising:

a floor-engaging main frame;

a user support frame;

a pivot assembly pivotally mounting the user support frame relative to the main frame which allows rotation of the user support frame between a start position and an end position, the pivot assembly having at least one pivot and defining a vertical gravitational center line of the pivotal movement of the user support frame;

the user support frame at least a primary support and a secondary support for supporting spaced positions on a user's body throughout an exercise movement, the secondary support being fixed at a predetermined angular orientation relative to the primary support, the primary support supporting the majority of a user's weight in the start position of the support frame;

a user engagement device movably mounted relative to the frames and having a first exercise arm having a first hand grip and a second exercise arm having a second hand grip, the first and second hand grips being engaged by the user positioned on the user support when performing a rowing exercise, each exercise arm having a rigid portion extending from the respective hand grip along at least part of the length of the arm;

a connecting linkage associated with at least two of the main frame, user support frame, and user engagement device which translates movement of the user engagement device to movement of the user support frame;

a load for resisting movement of at least one of the user support, user engagement device, and connecting linkage;

the gravitational center line of the user support pivotal motion being positioned such that portions of the combined weight of the user and user support frame are distributed on each side of the gravitational center line of the pivotal motion in at least one of the start and end position and only a portion of the combined weight passes through the gravitational center line during the exercise movement; and the exercise arms being slidably mounted for linear motion relative to the main frame.

52. The machine of claim 46, further comprising a flexible member linking the exercise arms and associated with at least one of the main frame and connecting linkage.

53. The machine of claim 43, wherein the hand grip is at a lower elevation relative to the user support frame in the end position than in the start position of an exercise.

54. A rowing exercise machine, comprising:

a floor-engaging main frame having a front end and a rear end;

a user support frame;

a pivot assembly pivotally mounting the user support frame relative to the main frame and adapted to define a rotation path of the user support frame about the pivot assembly between a start position and an end position of an exercise movement, the pivot assembly having at least one pivot and defining a vertical gravitational center line of the pivotal movement of the user support frame;

the user support frame adapted to support a user in an exercise position facing the front end of the main frame, the user support frame having at least a primary support and a secondary support for supporting spaced positions on a user's body throughout an exercise movement, the primary support supporting the majority of a user's weight in the start position of the support frame, and the secondary support comprising a foot support which is secured at a fixed angular orientation relative to the primary support whereby no part of the foot support is movable relative to the primary support as the user support frame travels between the exercise start and end positions during the exercise movement;

a user engagement device movably mounted relative to one of the frames, the user engagement device having at least one partially rigid portion having a hand grip engaged by the user in performing rowing exercises and adapted to move in an exercise path between exercise start and end positions;

a connecting linkage which translates movement of the user engagement device to movement of the user support frame; and a load for resisting movement of at least one of the user support, user engagement device, and connecting linkage.

55. The machine of claim 1, wherein the user support frame supports a user in a seated position, the primary support comprises a seat pad and the secondary support comprises a lower body engaging pad.

56. The machine of claim 55, wherein the lower body engaging pad comprises a foot support for the user's feet.

* * * * *

UNITED STATES PATENT AND TRADEMARK OFFICE

CERTIFICATE OF CORRECTION

PATENT NO. : 7,766,802 B2
APPLICATION NO. : 12/105833
DATED : August 3, 2010
INVENTOR(S) : Randall T. Webber et al.

It is certified that error appears in the above-identified patent and that said Letters Patent is hereby corrected as shown below:

Column 20, line 23, after "user support frame" insert --having--.

Signed and Sealed this

Twelfth Day of October, 2010

David J. Kappos

David J. Kappos
*Director of the United States Patent and Trademark Office*